United States Patent [19]

Sabol

[11] 4,222,437

[45] Sep. 16, 1980

[54] METHOD FOR IN SITU GAS PRODUCTION FROM COAL SEAMS

[76] Inventor: Karol Sabol, 3116 - 67A St., Edmonton, Alberta, Canada

[21] Appl. No.: 38,949

[22] Filed: May 14, 1979

[30] Foreign Application Priority Data

May 15, 1978 [CA] Canada ..... 303287

[51] Int. Cl.[2] ..... E21B 43/24

[52] U.S. Cl. ..... 166/245; 166/256; 166/258

[58] Field of Search ..... 166/245, 251, 256, 258, 166/259; 48/DIG. 6; 299/2

[56] References Cited

U.S. PATENT DOCUMENTS

| | | | |
|---|---|---|---|
| 3,004,594 | 10/1961 | Crawford | 166/259 |
| 3,050,116 | 8/1962 | Crawford | 166/258 |
| 3,116,792 | 1/1964 | Purre | 166/245 |
| 3,126,956 | 3/1964 | Berry, Jr. | 166/258 |
| 3,138,203 | 6/1964 | Weiss et al. | 166/258 X |
| 3,241,611 | 3/1966 | Dougan | 166/245 |
| 3,386,504 | 6/1968 | Kunetka | 166/245 |
| 3,865,186 | 2/1975 | Von Hippel | 166/256 |
| 4,026,356 | 5/1977 | Shuck | 166/245 X |
| 4,116,273 | 9/1978 | Fisher et al. | 166/256 X |
| 4,124,071 | 11/1978 | Allen et al. | 166/245 X |

FOREIGN PATENT DOCUMENTS

| | | | |
|---|---|---|---|
| 220814 | 8/1957 | Australia | 48/DIG. 6 |

*Primary Examiner*—Stephen J. Novosad
*Assistant Examiner*—George A. Suchfield
*Attorney, Agent, or Firm*—Shlesinger, Arkwright, Garvey & Dinsmore

[57] ABSTRACT

Gas is produced and extracted from a coal deposit by drilling a row of supply wells in the deposit for receiving air or another combustion supporting gas, cutting horizontal inclined supply passages along the bottom of the deposit extending from the bottom end of the supply wells to a channel at the other end of the deposit perpendicular to and interconnecting the supply passages, igniting the coal face in the channel to create a combustion zone, maintaining combustion by continuously supplying air to the combustion zone via the supply wells and supply passages, and continuously removing gases produced by combustion via a central discharge passage extending along the deposit parallel to the supply passages and production wells drilled from the surface to the discharge passage in a row perpendicular to the row of supply wells.

5 Claims, 7 Drawing Figures

METHOD FOR IN SITU GAS PRODUCTION FROM COAL SEAMS

FIELD OF THE INVENTION

This invention relates to a method of producing and recovering gas from solid carbonaceous deposits, and in particular to the production of gas in coal beds.

BACKGROUND OF THE INVENTION

There are presently available many methods for the in situ production of hydrocarbon gases from solid beds of carbonaceous material. One of the single greatest problems encountered in such methods is the effective supplying of air to burning sites. Once coal or another carbonaceous material has been ignited, it is essential that combustion be maintained. The prior art offers a variety of approaches to the problem. Examples of proposed solutions to the problems encountered with in situ gas production processes are found in U.S. Pat. No. 3,113,619, issued to A. D. Reichle on Dec. 10, 1963; U.S. Pat. No. 3,794,113 issued to L. K. Strange on Feb. 26, 1974; U.S. Pat. No. 3,997,005, issued to C. A. Komar on Dec. 14, 1976; U.S. Pat. No. 3,999,607, issued to R. E. Pennington et al on Dec. 28, 1976; U.S. Pat. No. 4,026,356, issued to L. Z. Shuck on May 31, 1977 and U.S. Pat. No. 4,054,393, issued to S. T. Fisher et al on Aug. 23, 1977.

The above patents propose a variety of solutions to the problems involved in the in situ production of gases in deposits of carbonaceous material, including (a) the inverse or counterflow injection of air to a combustion zone; (b) the use of a heated fluid to maintain a heated zone about a production well using steam in a direct combustion process; (c) the use of the natural fracture system in certain coals and the regulation of combustion supporting gas pressure; (d) the burning of coal over a limited area of a seam, collapsing overlying coal to form a rubblized zone, burning the rubblized zone and collecting the liquids and gases thus produced; (e) the forming of directional bores in coal beds using a laser beam to interconnect selected holes bored by conventional methods; and (f) the heating of a selected portion of a coal deposit using electrical induction techniques, whereby destructive distillation of the coal is effected. Most of the methods discussed above are either relatively complicated and expensive, or alternatively rely for success on the permeability of a carbonaceous deposit. In any event, a review of the literature and current methods for in situ production of gas in carbonaceous deposits makes it readily apparent that there is a need for a relatively simple, efficient method for the in situ production of gas in such deposits.

SUMMARY OF THE INVENTION

The object of the present invention is to provide such a method.

Accordingly, the present invention relates to a method for producing gas in a solid carbonaceous deposit comprising the steps of drilling a plurality of spaced apart supply wells in a line at one location in the deposit for receiving a combustion supporting gas; cutting a substantially horizontal supply passage at the bottom end of each said supply well extending through the deposit away from said well; drilling auxiliary wells at other locations in said deposit remote from said supply wells and communicating with selected of said supply passages; cutting a channel between the bottom ends of said auxiliary wells to interconnect the ends of said supply passages remote from said supply wells; drilling a row of gas production wells substantially perpendicular to said line of supply wells and communicating with a discharge passage extending from said channel to said line of supply wells, said discharge passage being substantially parallel to and in the same horizontal plane as said supply passages; igniting the carbonaceous deposit in said channel to create a combustion zone; continuously removing gases produced in said combustion zone via said discharge passage and at least one of said production wells while maintaining combustion in said combustion zone by feeding combustion supporting gas thereto via said supply wells and said supply passages.

In the simplest form of the method of this invention, supply wells are drilled into one end of a coal seam, and the supply passages are formed at the bottom of the seam along the length thereof. A combustion zone is established at the opposite end of the seam perpendicular to the supply passages, and gases thus produced are withdrawn through a discharge passage extending along the centre of the seam parallel to and between two adjacent supply passages, and then through production wells provided along the length of the discharge passage. The auxiliary wells are drilled at the ends of the combustion zone, and are used to ignite the seam, i.e. start combustion and to monitor combustion. As air is supplied in one direction, the combustion zone proceeds along the coal seam in the opposite direction. With such an arrangement, virtually all of the coal in the seam is consumed. If caving occurs, there is no interruption of (i) the air supply to the combustion zone or (ii) gas production, because both take place ahead of the combustion channel.

The method of the present invention can also be used in large areas, i.e. large coal seams, in which case a single row of supply wells is used to supply two combustion zones simultaneously. With such an arrangement the combustion zones are located on opposite sides of the supply wells, and move towards each other during gas production. This represents a relatively inexpensive method of production.

In a third alternative, the method of the invention may be used in locations where two or more coal seams lay one above the other. The coal seams may be parallel and/or inclined. In any event, a single set of supply wells is used to supply combustion supporting gas or air to the combustion zone in each seam or layer, and the gas produced in the various layers is discharged through common production wells.

Efficient utilization of the method described above is made possible by the apparatus described in applicant's U.S. Pat. application Ser. No. 854,084 filed Nov. 23, 1977 which facilitates the cutting of the horizontal supply and discharge passages which application is incorporated by reference herein.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENT(S)

Figure 1:
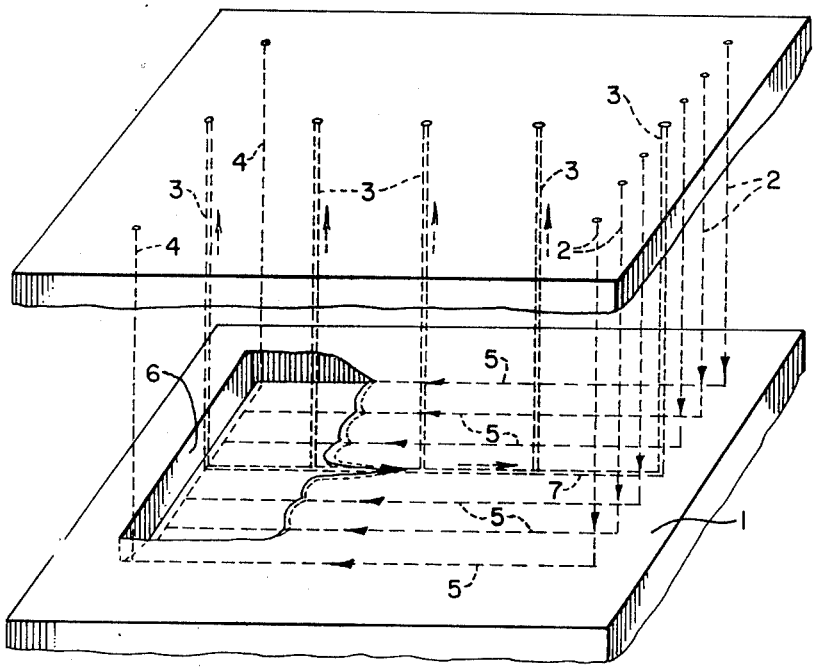
FIG. 1 is a schematic perspective view of a coal deposit, in which the method of the present invention is being employed to produce gas.

With reference to the drawings, and in particular to FIG. 1, the method of the present invention is used to produce and extract gas from a subterranean formation of carbonaceous material; in the present case we are concerned with a seam 1 of coal. The first step in the method is to drill a row of air supply wells 2 at one end of the seam, the wells 2 extending to the bottom of the seam 1. Then, a row of gas production wells 3 is drilled at the centre of and perpendicular to the row of supply wells 2. Auxiliary wells 4 are drilled in a line parallel to the row of supply wells 2 and the same distance away from such supply wells as the outermost production well 3. Horizontal supply passages 5 are formed using an apparatus of the type disclosed by applicant's copending U.S. patent application Ser. No. 854,084, filed Nov. 23, 1977, now U.S. Pat. No. 4,168,752, mentioned hereinbefore. The supply passages 5 extend from the bottom ends of the supply wells 2 to the auxiliary wells 4, and their outer ends are interconnected by a transverse channel 6. The channel 6 extends between the auxiliary wells 4 and intersects the bottom end of the outermost production well 3. The channel 6 is preferably oriented at 90° to the direction of cleavage of the coal seam 1. A horizontal discharge passage 7 is formed between the production wells 3. The discharge passage 7 is parallel to the supply passages 5 and extends from the row of supply wells 2 to the channel 6 midway between and parallel to the supply passages 5.

While the spacing between the various passages and channels is not critical, a typical spacing between the air supply wells 2 is 100 to 150 feet, and between the production wells 3 at least 150 feet. The auxiliary wells 4 would be at least 1,000 feet from the line of air supply wells 2.

Figure 3:
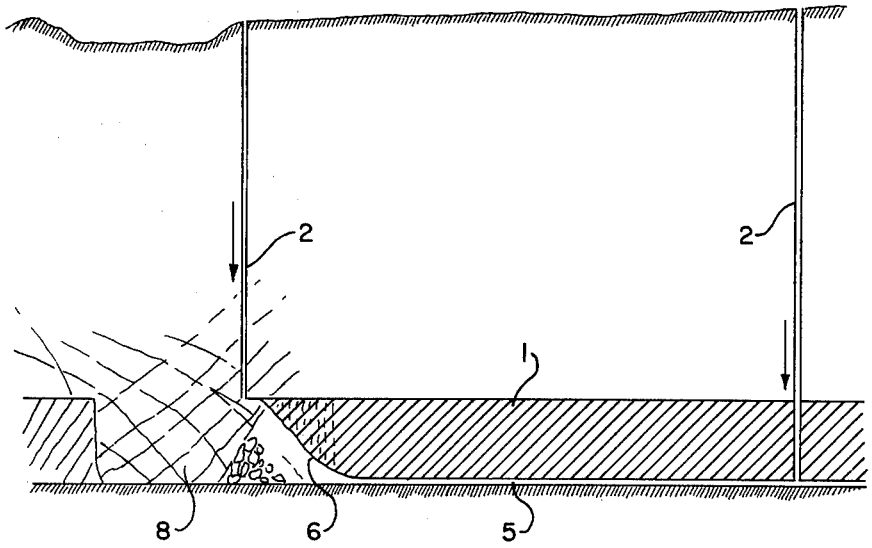
FIG. 3 is a cross-sectional view taken generally along line 3—3 of FIG. 2.
Figure 4:
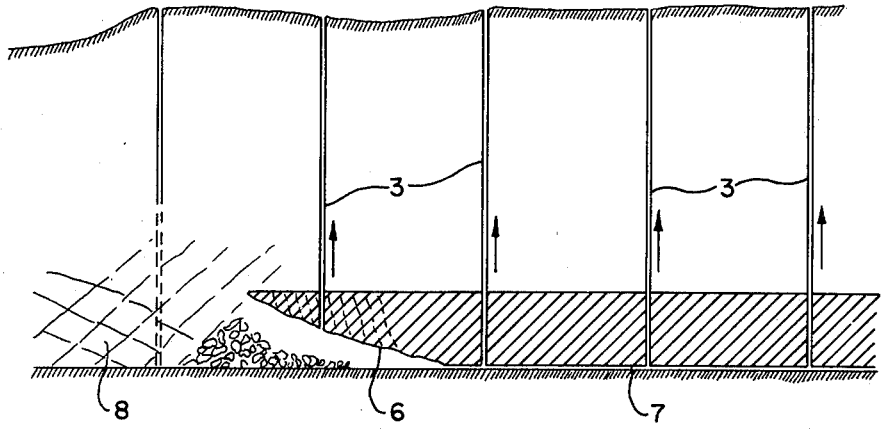
FIG. 4 is a cross-sectional view taken generally along line 4—4 of FIG. 2.

In operation, combustion is initiated in the coal seam by means of gas torches introduced into the channel 6 via the auxiliary wells 4. Air is supplied through the auxiliary wells 4 to cause the fire to spread along the entire length of the channel 6, such channel 6 becoming a combustion channel. Once combustion has been established along the entire length of the channel 6, air is supplied through the air supply wells 2 and the supply passages 5. Gas produced by combustion of the coal in the channel 6 is discharged via the outermost production well 3. As the combustion surface of the coal seam advances towards the supply wells 2, the coal gas produced by combustion is discharged via the passage 7 and the next production well 3. Air is continuously supplied to the combustion surface of the coal seam, and, as the combustion channel 6 reaches and passes a production well 3, gas will be discharged from the next production well until the end of the row of such wells has been reached. The combustion channel 6 can and does proceed in a direction counter-current to the air supply, whereby all of the coal in the seam 1 is consumed. When caving 8 (FIGS. 3 and 4) occurs, there is no interruption of the air supply or of gas production, since both occur in advance of the combustion channel 6. In other words, since the air supply comes from a direction opposite the direction of movement of the combustion channel 6, and since gases are discharged in the same direction as the direction of movement of the combustion channel 6, caving cannot affect either air supply or gas production.

Figure 2:
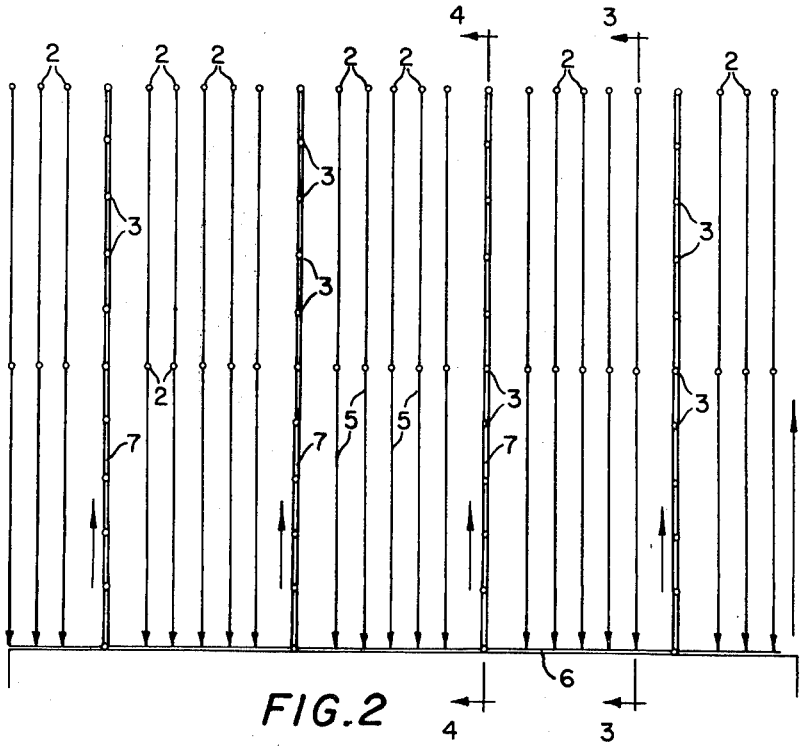
FIG. 2 is a schematic plan view of a coal seam, and also illustrates the method of FIG. 1.

As illustrated in FIG. 2, a plurality of rows of air supply wells 2 and gas production wells 3 can be employed in the method of the present invention. As the combustion channel 6 approaches the closest row of air supply wells 2, such wells are sealed and air is supplied via the next row of supply wells 2.

Employing the method disclosed above, combustion occurs from the floor or bottom of the coal seam 1, rising to the top thereof. Thus, the temperature of the coal above the combustion zone is raised prior to combustion, with a resulting increased efficiency. With heating, the permeability of the coal is increased, but even in the event of chaotic caving, gases will still pass through the discharge passage 7 to one of the production wells 3. Hot coal gas passing through the discharge passage 7 gradually increases the size of such passage and therefore its production capacity.

Figure 5:
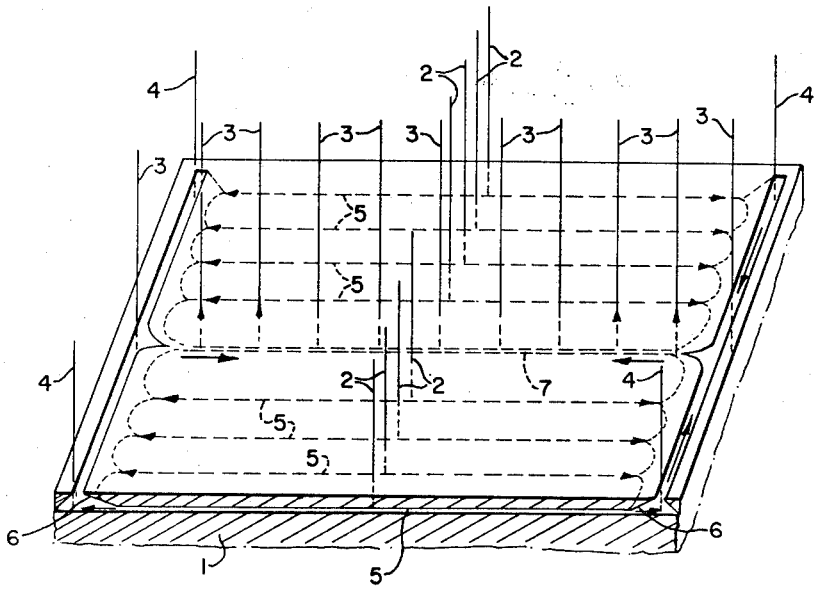
FIG. 5 is a schematic perspective view of a large coal seam in which the method of the present invention is being employed.
Figure 6:
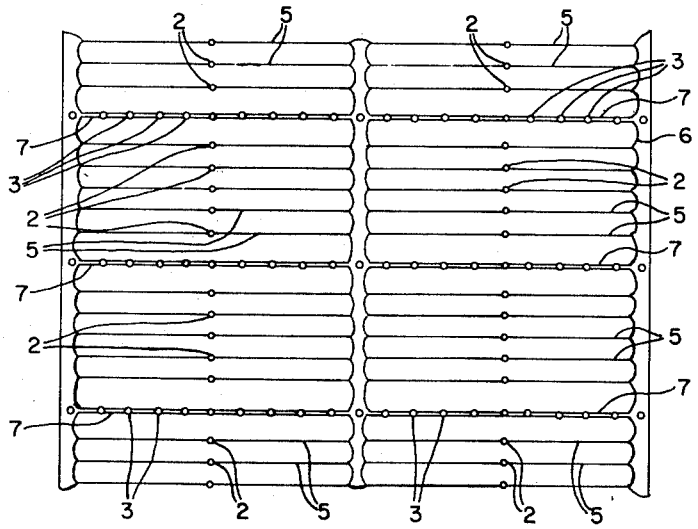
FIG. 6 is a schematic plan view of a large coal seam.
Figure 7:
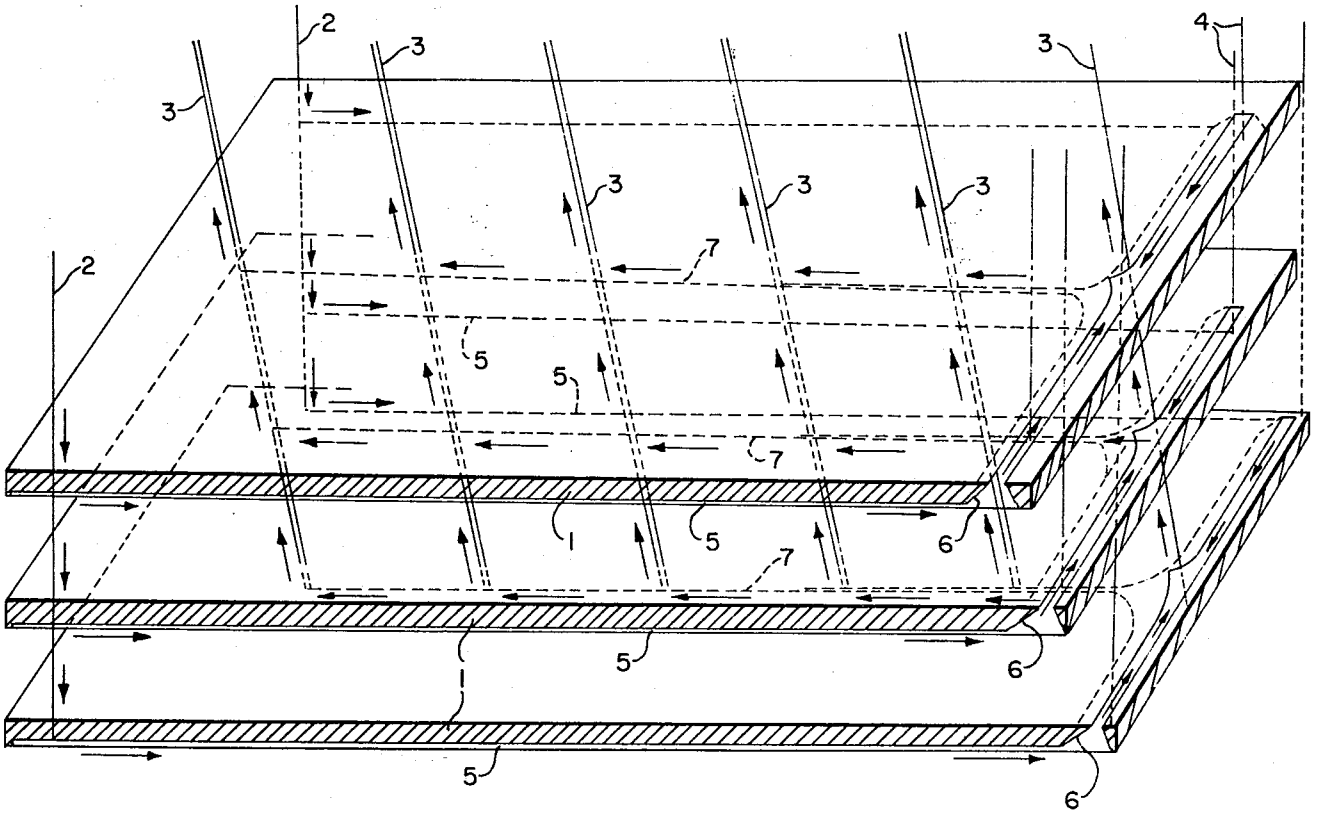
FIG. 7 is a schematic perspective view of coal seams in layers, and also illustrates the method of the present invention.

The use of the method of the present invention in a relatively large coal seam is illustrated in FIGS. 5 and 6. In a large coal seam 1, the air supply wells 2 are used to support combustion in two combustion channels 6 simultaneously. The result should be a reduction in development costs, with an increased yield of coal gas. It will be appreciated that the combustion channels 6 progress towards the row of air supply wells 2, while gas is constantly being discharged through the production wells 3 on each side of the row of supply wells 2.

The invention may also be used in coal fields where a plurality of seams are located one above the other. The seams 1 may be horizontal or inclined. In both cases, the air supply wells 2 extend downwardly through each of the seams 1, supply passages 5 are provided at the bottom of each of the seams 1, production wells 3 extend downwardly through each of the seams and a discharge passage 7 is provided in each seam. It will be appreciated that the method is exactly the same as in the case of a single coal seam. However, it is preferable to incline the production wells 3 at an angle to the vertical greater than the angle to the vertical of the seams, so that any caving will occur in the lowermost seam first, i.e. the top seam will be the last to be demolished in the event of caving. In any event, as previously discussed, if one of the production wells 3 is blocked by caving, the next well in the row of production wells would be brought into service.

Thus, there has been described a relatively simple and efficient method of producing gas in a subterranean carbonaceous deposit which does not rely on the permeability of the deposit or complicated methods of achieving combustion.

I claim:

1. A method for producing gas in a solid carbonaceous deposit comprising the steps of drilling a plurality of spaced apart supply wells in a line at one location in the deposit for receiving a combustion supporting gas;

cutting a substantially horizontal supply passage at the bottom end of each said supply well extending through the deposit away from said well; drilling auxiliary wells at other locations in said deposit remote from said supply wells and communicating with selected of said supply passages; cutting a channel between the bottom ends of said auxiliary wells to interconnect the ends of said supply passages remote from said supply wells; drilling a row of gas production wells substantially perpendicular to said line of supply wells and communicating with a discharge passage extending from said channel to said line of supply wells, said discharge passage being substantially parallel to and in the same horizontal plane as said supply passages; igniting the carbonaceous deposit in said channel to create a combustion zone; continuously removing gases produced in said combustion zone via said discharge passage and at least one of said production wells while maintaining combustion in said combustion zone by feeding combustion supporting gas thereto via said supply wells and said supply passages.

2. A method according to claim 1, wherein said carbonaceous deposit is a coal seam; said supply walls are drilled near one end of the coal seam; the supply passages are formed at the bottom of the coal seam extending along the length thereof; the combustion zone is established at the end of said coal seam opposite said one end and perpendicular to the supply passages; and the gas produced in the combustion zone is discharged through the discharge passage extending along the centre of the seam parallel to and between a pair of supply passages, and through at least one of a plurality of production wells extending upwardly from the discharge passage.

3. A method according to claim 1, wherein a second line of supply wells is drilled at a second location in the deposit, said second supply wells being substantially aligned with the first supply wells, a single supply passage extending from one of the second supply wells intersecting the bottom end of one of the first supply wells and terminating at the combustion zone, whereby, when the combustion zone reaches the first supply wells, combustion supporting gas is supplied to the combustion zone through the second supply wells.

4. A method according to claim 1, wherein combustion zones are established on each side of said line of supply wells, said combustion zones being connected to said supply wells by supply passages, and a row of gas production wells is drilled on each side of said line of supply wells communicating with a discharge passage extending from each combustion zone to the line of supply wells.

5. A method according to claim 1, wherein said carbonaceous deposit is a plurality of spaced apart seams disposed one above the other; a single line of supply wells is drilled through each seam; horizontal supply passages are cut at the bottom of each seam; a single set of auxiliary wells are drilled at other locations extending through each seam; a channel is cut in each seam interconnecting the ends of the supply passages remote from the supply wells; and a single row of gas production wells is drilled to communicate with a discharge passage at the bottom of each seam, each seam being ignited to create a combustion zone in each seam and the gases thus produced are simultaneously discharged from all seams via the discharge passage and at least one of the production wells.

* * * * *